US010343043B1

(12) United States Patent
Minotti

(10) Patent No.: US 10,343,043 B1
(45) Date of Patent: Jul. 9, 2019

(54) SEQUENCE TRAINING BAT

(71) Applicant: David M. Minotti, Pfafftown, NC (US)

(72) Inventor: David M. Minotti, Pfafftown, NC (US)

( * ) Notice: Subject to any disclaimer, the term of this patent is extended or adjusted under 35 U.S.C. 154(b) by 0 days.

(21) Appl. No.: 15/790,295

(22) Filed: Oct. 23, 2017

Related U.S. Application Data

(60) Provisional application No. 62/412,874, filed on Oct. 26, 2016.

(51) Int. Cl.

| | |
|---|---|
| ***A63B 69/00*** | (2006.01) |
| ***A63B 60/42*** | (2015.01) |
| ***A63B 60/20*** | (2015.01) |
| ***A63B 60/10*** | (2015.01) |
| ***A63B 59/50*** | (2015.01) |

(52) U.S. Cl.
CPC ..... *A63B 69/0002* (2013.01); *A63B 60/10* (2015.10); *A63B 60/20* (2015.10); *A63B 60/42* (2015.10); *A63B 59/50* (2015.10); *A63B 2069/0008* (2013.01)

(58) Field of Classification Search
CPC ..... A63D 15/08; A63B 69/00; A63B 69/36
See application file for complete search history.

(56) References Cited

U.S. PATENT DOCUMENTS

| | | | | |
|---|---|---|---|---|
| 5,362,059 | A | 11/1994 | Grossman | |
| 5,388,834 | A | 2/1995 | Dawson | |
| 5,997,408 | A * | 12/1999 | Bankhead | A63B 69/3608 473/227 |
| 6,482,113 | B1 | 11/2002 | Finn | |
| 7,544,135 | B1 | 6/2009 | Higgins | |
| 7,674,185 | B2 | 3/2010 | Omidi | |
| 7,896,755 | B2 | 3/2011 | Eddy | |
| 2006/0079341 | A1 | 4/2006 | Mansour | |
| 2009/0017931 | A1 | 1/2009 | Kurisu | |
| 2009/0093319 | A1 * | 4/2009 | Omidi | A63B 15/00 473/219 |
| 2009/0258734 | A1 * | 10/2009 | Souders | A63B 69/0002 473/453 |
| 2014/0274488 | A1 | 9/2014 | Garthwaite | |
| 2016/0038819 | A1 | 2/2016 | Daniel | |
| 2016/0184693 | A1 * | 6/2016 | Gulyassy | A63D 15/08 473/44 |

FOREIGN PATENT DOCUMENTS

| | | | |
|---|---|---|---|
| JP | 2003334270 | A | 11/2003 |
| JP | 200424949 | A | 9/2004 |

* cited by examiner

*Primary Examiner* — Eugene L Kim
*Assistant Examiner* — Christopher A Glenn
(74) *Attorney, Agent, or Firm* — Werschulz Patent Law, LLC; Patricia P. Werschulz, Esq.

(57) ABSTRACT

A sequence training bat that separates a pair of hands of a batter when training so that the batter feels the proper sequence of hand and arm movements. The training bat has a barrel connecting through a crosspiece to a handle for a bottom hand to grip and parallel to the bat handle, a rod for a top hand to grip. The rod connects to the bat by the crosspiece. Vibrations resulting from hitting a ball are minimized when they travel down the barrel to the crosspiece where they are horizontally dispersed, allowing better and instant feedback to the batter without any confusion caused by vibrations. Each hand grips a different part of the training bat so that the sequence training bat can provide immediate and separate feedback to each hand. The sequence training maintains a balanced feel.

10 Claims, 5 Drawing Sheets

SEQUENCE TRAINING BAT

CROSS-REFERENCE TO RELATED APPLICATIONS

This application is a nonprovisional utility application of the provisional patent application, Ser. No. 62/412,874, filed in the United States Patent Office on Oct. 26, 2017 and claims the priority thereof and is expressly incorporated herein by reference in its entirety.

TECHNICAL FIELD

The present disclosure relates generally to a baseball training bat. More particularly, the present disclosure relates to a training bat for training players in the proper swing sequence.

BACKGROUND

Baseball is a popular sport both nationally in the United States and internationally as well. Youngsters love playing baseball, both with friends in a "sandlot" game as well as in local leagues. The children imitate professional players and dream of playing as a professional.

Baseball is popular sport at all scholastic levels up through and including college. Because baseball is played so extensively by young players, it is especially important that they be properly trained in the correct manner when practicing and competing.

While pitching and fielding are key defensive skills that players must master, hitting the ball well is a key offensive skill. While strength and agility are important in every aspect of the sport, proper execution of the swing is critical to hitting the ball well.

Young players must learn the proper swing for many reasons, not the least of which to prevent injury, both while playing as youths and in the future as adults. Learning to swing properly is a matter of training the muscles to act together in a particular way to develop so called muscle memory. The more times an action is repeated, the more the muscles repeat the action with increasing ease until the action is executed without conscious thought. Unfortunately, when the action is not properly executed repeatedly, muscles remember the improper form. Muscles trained to execute with bad form are more challenging to train to use the proper form, because unlearning the bad habits is required as well as learning the proper way.

The bio-mechanics behind the baseball swing, simply starts with holding the bat properly, lining up top and bottom hands. The trailing and leading arms work together and drive forward in sequence as one, but each hand has a very distinct and different movement. These movements, when executed properly, place the bat at the optimum angle and maximize plate coverage. When a player executes the sequence correctly, the energy from the lower body transfers to the upper body and then to the bat, maximizing the amount of energy impacting the ball.

Many devices have been proposed and used to train the young player, but none that solve the problem completely. While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a training bat that allows a batter to feel a top hand movement separately from a bottom hand movement. Accordingly, an aspect of an example embodiment in the present disclosure provides a training bat that has a bat handle for a bottom hand and a connected rod for a top hand.

Another aspect of an example embodiment in the present disclosure is to provide a training bat that allows a batter to feel a sequence of movements of a top hand separately from the sequence of movement of a bottom hand. Accordingly, the present disclosure provides a training bat that has a crosspiece that separates a bat handle for a bottom hand from a rod for a top hand.

A further aspect of an example embodiment in the present disclosure is to provide a training bat that transmits a minimum of vibrations to a pair of hands when a ball is hit. Accordingly, the present disclosure provides a training bat that has a crosspiece that connects a bat barrel to a bat handle, causing vibrations in the bat barrel to travel vertically down to the crosspiece and disperse horizontally across the crosspiece, minimizing the vibrations to the hands on the handle and rod.

Yet another aspect of an example embodiment in the present disclosure is to provide a training bat that allows a batter to understand the strengths and weaknesses of both hands. Accordingly, the present disclosure provides a training bat that has a bat connecting to a rod by a crosspiece so that each hand grips a different part of the training bat so that the sequence training bat can provide separate feedback to each hand.

Accordingly, the present disclosure describes a sequence training bat having an innovative biomechanical design that uniquely separates a pair of hands of a batter when training so that the batter may "feel to learn" the proper sequence of hand and arm movements. The training bat has a barrel connecting through a crosspiece to a handle for a bottom hand to grip and a rod parallel to the bat handle, the rod for a top hand to grip. The rod connects to the bat by the crosspiece. The training bat allows the batter to feel separate hand movements in their proper sequence. Vibrations resulting from hitting a ball are minimized when they travel down the barrel to the crosspiece where they are horizontally dispersed, allowing better and instant feedback to the batter without confusion caused by vibrations. Each hand grips a different part of the training bat so that the sequence training bat can provide immediate and separate feedback to each hand. The sequence training bat has a shorter barrel than regulation, the entire bat maintaining the feel and balance of a regulation bat.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
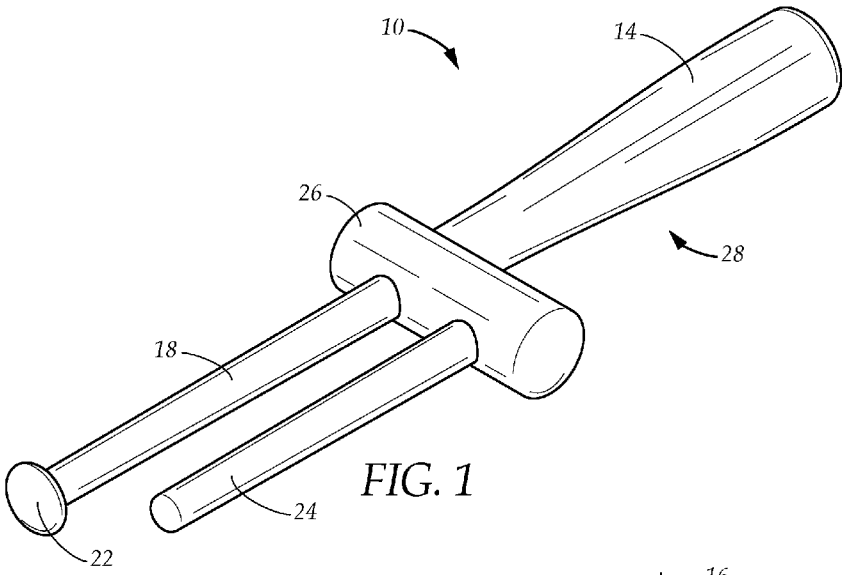
FIG. 1 is a perspective view of an example embodiment of a sequence training bat.
Figure 1A:
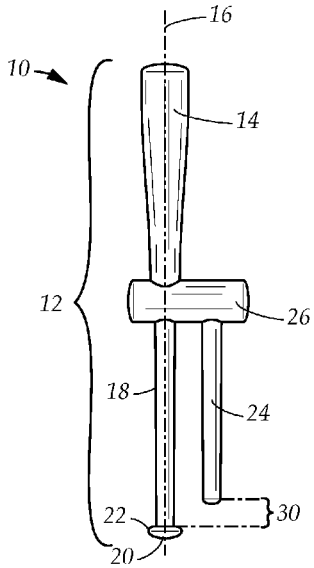
FIG. 1A is a front elevational view of the example embodiment of the sequence training bat.

FIGS. 1 and 1A illustrates a sequence training bat 10 for training a batter in the proper sequence of movements that maximizes energy transference from the lower body to the upper body through the arms and hands to the bat as explained hereinbelow.

The sequence training bat 10 comprises a bat 12, a rod 24 and a crosspiece 26. The bat 12 further comprises a barrel 14 with a lengthwise center barrel axis 16, a handle 18 with a lengthwise center handle axis 20 and a bottom knob 22. The handle 18 and barrel 14 are discrete; that is, they are individually separate and distinct.

The crosspiece 26 connects the barrel 14 and handle 18 together, the center axis 16 of the barrel 14 and the center axis 20 of the handle 18 forming a straight line. The barrel 14 extends upwardly from the crosspiece 26.

The bat 12 when assemble with the crosspiece 26 is about three-quarters (¾) the length of a regulation length baseball bat. The barrel 14 is shorter. It is understood by those of ordinary skill that the length of the bat 12 in the sequence training bat 10 will vary depending on the age of the batter 40, whether the batter 40 is in a youth, scholastic or professional league.

All bats, including the sequence training bat 10, have a sweet spot where when the ball is hit, where the ball absorbs the maximum amount of available forward momentum and rebounds away from the bat. The sequence training bat 10 having a shorter barrel 14 with a smaller sweet spot 28 above the crosspiece 26 requires the batter to focus on accuracy when swinging.

The crosspiece 26 connects the bat 12 with the rod 24, the rod 24 extending downwardly from the crosspiece 26 parallel to the handle 18 of the bat. The rod 24 is a handbreadth 30 shorter than the handle 18. The rod 24 does not extend above the crosspiece 26. The sequence training bat 10 having the assembled bat 12 with the shortened barrel 14, rod 24 and crosspiece 26 does not weigh more the regulation bat, because the purpose of the sequence training bat 10 is not strength training, but learning the proper sequence each hand must perform in the act of hitting a ball.

The sequence training bat 10 has a biomechanical design that uniquely separates a batter's pair of hands when swing training, allowing the batter to actually feel a top hand and a bottom hand move separately as that the hands move in proper sequence upon impact. The sequence training bat 10 provides a very balanced feel because of the roughly equivalent weight to a regulation size bat even with the crosspiece 26 and rod 24.

Figure 2:
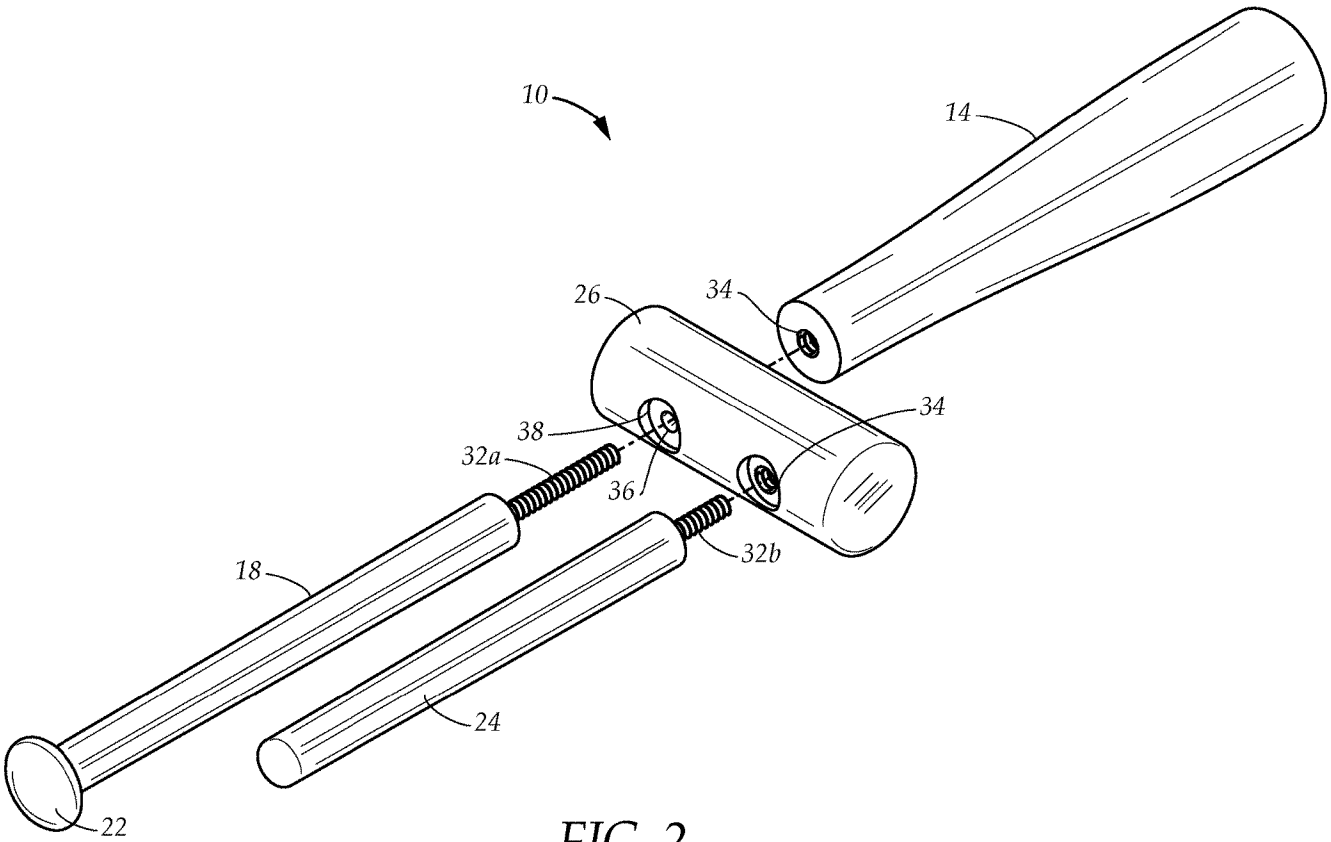
FIG. 2 is an exploded view of the example embodiment of the sequence training bat.

FIG. 2 shows how the sequence training bat 10 is assembled. The crosspiece 26 has a through hole 36 and a threaded hole 34. The crosspiece 26 has a plurality of cutouts 38 configured for receiving the handle 18, the barrel 14 and the rod 24. The through hole 36 is in between a pair of opposing round cutouts 38 (only one is visible in the drawing) and the threaded hole 34 is in a round cutout.

The barrel 14 has a bottom with a threaded hole 34. The handle 18 has a top with a threaded hole 34. A first fastener 32*a* joins the handle 18 and the barrel 14 by threading into the threaded hole 34 in the top of the handle 18, passing through the through hole 36 in the crosspiece 26 and threading into the threaded hole 34 in the bottom of the barrel 14.

A second fastener 32*b* joins the rod 24 to the crosspiece 26. The rod 24 has a top with a threaded hole 34. The second fastener 32*b* threads into the threaded hole 34 of the rod 24 and into the threaded hole 34 of the crosspiece 26.

It is understood by those of ordinary skill in the art the fastener 32 shown in the Figures can be a headless bolt, a headless screw, a stud, a rod or other similar threaded fasteners and the fasteners 32 as drawn are not a limitation. Further, it is understood that the holes do not need to be threaded to receive the fastener and that other variations of the fastener and holes are possible. In one example embodiment, the first fastener 32*a* and the second fastener 32*b* are metal.

When the sequence training bat 10 is assembled, the handle 18, barrel 14 and rod 24 insert through the cutouts 38 into the crosspiece 26.

The sequence training bat 10 as assembled distributes a plurality of vibrations that result when the barrel 14 hits a ball. The vibrations travel down the barrel 14 vertically and distribute across the crosspiece 26 horizontally, minimizing the vibrations the batter feels in the hands. In the example embodiment, wherein the fasteners 32 are preferably metal, the metal fasteners aid in the distribution of the vibrations. The first fastener 32*a*, the second fastener 32*b* and the crosspiece 26 are configured to distribute a plurality of vibrations resulting from hitting a ball with the barrel.

Assembling the sequence training bat 10 is accomplished by threading a fastener 32 into the threaded hole 34 of the handle 18, passing the fastener 32 through the through hole 36 of the crosspiece 26 and threading the fastener 32 into the threaded hole 34 of the barrel 14. The rod 24 is threaded into the cross piece by threading a fastener 32 into the threaded hole 34 of the rod 24 and threading the fastener 32 into the crosspiece 26. The order of assembly can be changed and the threading can be done in any order.

Figure 3:
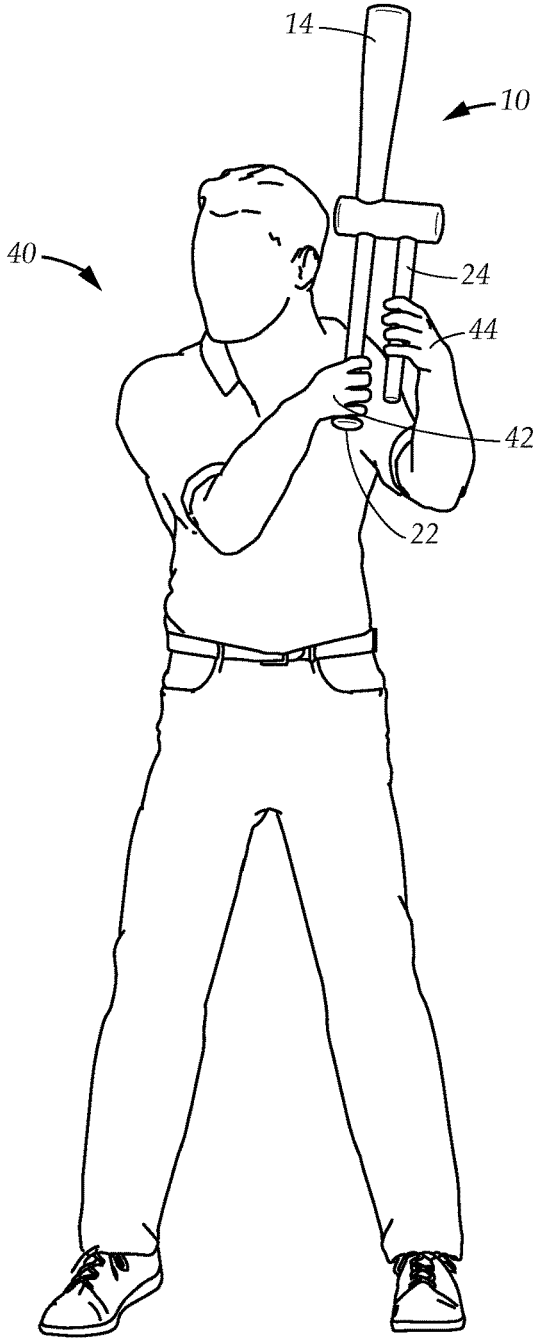
FIG. 3 is a perspective view of a player holding the example embodiment of the sequence training bat in position.
Figure 4:
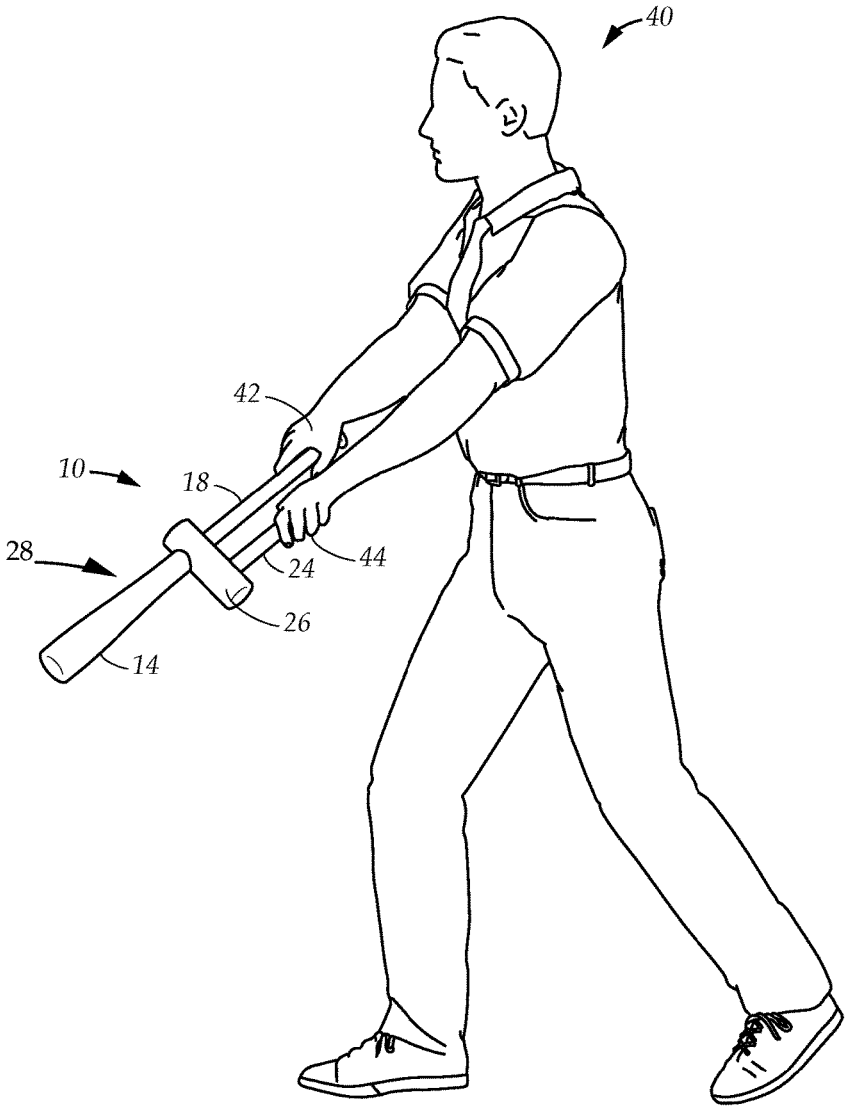
FIG. 4 is a perspective view of the player swinging the example embodiment of the sequence training bat in position.
Figure 5:
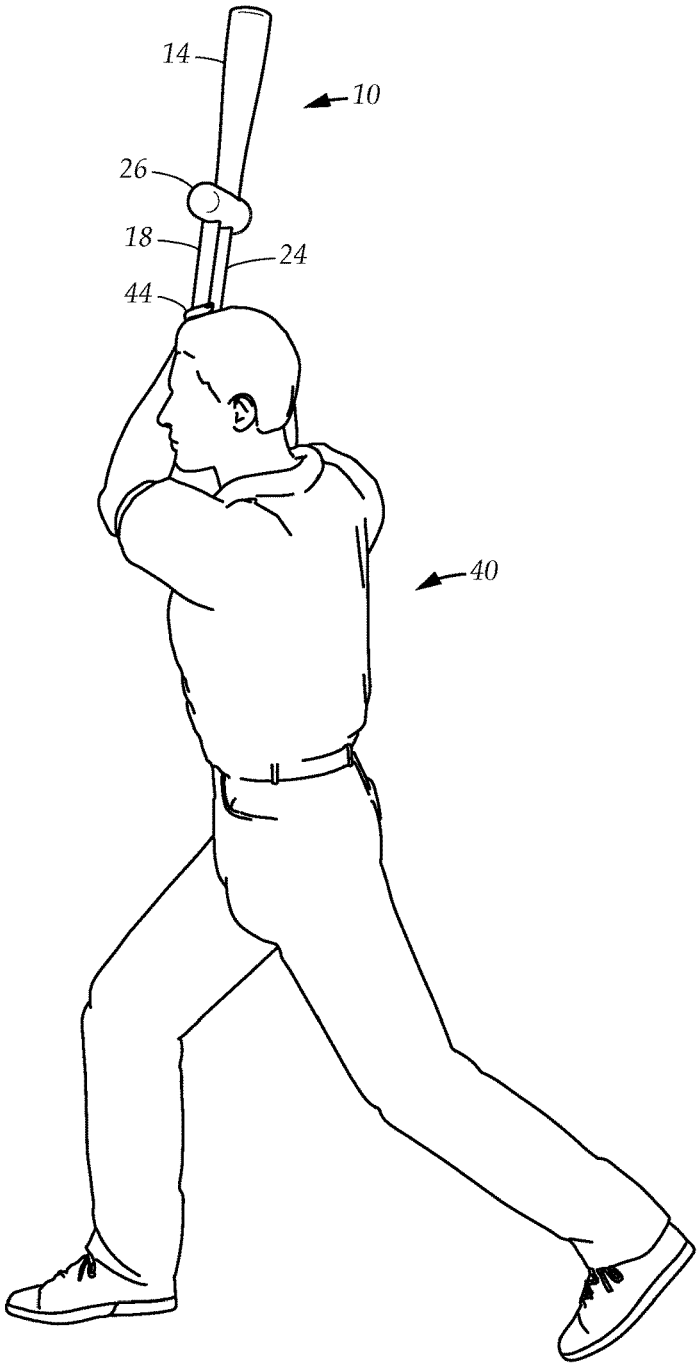
FIG. 5 is a perspective view of the player following through with the example embodiment of the sequence training bat in position.

FIGS. 3-5 show how the sequence training bat 10 is used to train a batter 40 in the proper use of the hands when hitting the ball. The Figures show the initial grip (FIG. 3), the extension of the hands and arms after contact (FIG. 4) and the follow through (FIG. 5). Each shoulder, each elbow, each wrist and each hand must move in a distinct path that differs from the other.

The crosspiece 26 requires that the batter 40 grips the handle 18 above the knob 22 by the bottom hand 42 and the rod 24 by the top hand 44. The handle 18 is configured for gripping above the knob 22 by the bottom hand 42 and the rod 24 is configured for grasping by the top hand 44 so that it is useful by all batters. A batter 40 who "bats left" as shown in the Figures uses a right (leading) hand to grip the handle 18. At it is understood by a person of ordinary skill in the art, a batter 40 who "bats right" places the leading or left hand on the handle 18.

The crosspiece 26 separates the rod 24 from the handle 18 at a set distance. The left-handed batter 40 grips the rod 24 with a left (following) hand. Because the rod 24 is a handbreadth 30 shorter than the handle 18, the batter 40 is forced to place the following hand about a handbreadth 30 above the leading hand, so that the following hand is in the top position and the leading hand is in the bottom position as it would be on a regulation bat.

The crosspiece 26 separates a plurality of vibrations from the sweet spot 28 on the barrel 14 from the handle 18 and rod 24. Often time, coaches and batter 40*s* alike find that vibrations sometimes are confusing as indicators of whether a swing and hit were well executed. By separating the hands and minimizing the vibrations, unique attributes of the sequence training bat 10, the batter 40 can feel the difference in the movements required of each hand during the swing without the confusion of the vibrations. The immediate result is positive feedback to the batter 40 from the sequence training bat 10 providing the batter 40 with an instant understanding of both hands' and arms' movements, as well as their relative strengths and weaknesses. The results are inspiring, increasing the batter's 40 ability to improve specific hand and arm movements for a more consistent and powerful swing.

As the batter 40 trains, he or she will realize when each hand must move or rotate, when each wrist must flex, and how and when each elbow and shoulder moves to execute a powerful and accurate swing. Minimizing the vibrations prevents confusing feedback to the batter 40, who may feel strong vibrations when batting with a regulation bat, which does not always correlate to a properly hit ball or that the ball was hit by the sweet spot 28. The shorter barrel 14 requires a focus on accuracy in order to hit the sweet spot 28. Because the vibrations are suppressed, the batter 40 must focus on form and visualization when hitting.

It is understood that when an element is referred hereinabove as being "on" another element, it can be directly on the other element or intervening elements may be present therebetween. In contrast, when an element is referred to as being "directly on" another element, there are no intervening elements present.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed above could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a sequence training bat. The disclosure is illustrated by example in the drawing figures, and throughout the written description. It should be understood that numerous variations are possible, while adhering to the inventive concept. Such variations are contemplated as being a part of the present disclosure.

What is claimed is:

1. A sequence training bat, comprising:

a rod;

a bat having a separable and discrete barrel and a separable and discrete handle; and a crosspiece connecting said rod and said barrel of the bat and said handle of the bat, said rod and said handle extending downward from the crosspiece in parallel to the rod, said barrel extending upward from the crosspiece, said barrel and said handle joining by a connecting to and passing through a first hole in the crosspiece, said handle and said barrel linearly connecting through the crosspiece, the crosspiece having a second hole, the rod connecting to the crosspiece through the second hole, the first hole and the second hole each having a cutout opening leading into a smaller indented hole, the crosspiece dispersing vibrations horizontally, minimizing the vibrations to said handle and said rod.

2. The sequence training bat as described in claim 1, wherein the crosspiece separates a plurality of vibrations from a sweet spot on the barrel from said handle and said rod.

3. A sequence training bat, comprising:

a bat, having a separable and discrete barrel and a separable and discrete handle, said handle having a knob;

a rod; and a crosspiece having a pair of holes, each hole having a cutout opening on a surface of the crosspiece and a smaller interior opening, the crosspiece connecting said barrel of the bat to said handle of the bat through a first hole, the small interior opening of said first hole have a through bore, the rod extending down from the crosspiece, parallel to said handle of the bat, connecting to the crosspiece through a second hole.

4. The sequence training bat as described in claim 3, wherein a first fastener connects said handle to said barrel through the first hole in the crosspiece.

5. The sequence training bat as described in claim 4, wherein a second fastener connects the rod to the crosspiece through the second hole.

6. The sequence training bat as described in claim 5, wherein the first fastener, the second fastener and the crosspiece are configured to distribute a plurality of vibrations resulting from hitting a ball with said barrel.

7. A sequence training bat, comprising:

a separable and discrete barrel with a lengthwise center axis;

a separable and discrete handle with a lengthwise center axis and a bottom knob;

a rod; and a crosspiece connecting the separable and discrete barrel and the separable and discrete handle together with the rod, the center axis of the separable and discrete barrel and the center axis of the separable and discrete handle forming a straight line, the rod extending downward from the crosspiece parallel to the separable and discrete handle, the crosspiece having a pair of holes, each hole having a cutout opening on a surface of the crosspiece and a smaller interior opening for receiving a fastener.

8. The sequence training bat as described in claim 7, wherein the rod is a handbreadth shorter than the separable and discrete handle and the separable and discrete handle is configured for grasping above the knob by a bottom hand and the rod is configured for grasping by a top hand, one handbreadth above the bottom hand.

9. The sequence training bat as described in claim 7, wherein a first fastener connects the separable and discreet handle to the separable and discrete barrel through a first hole in the crosspiece, the smaller interior opening of the first hole having a through bore and a second fastener inserts into the smaller interior opening of a second hole, connecting the rod to the crosspiece.

10. The sequence training bat as described in claim 9, wherein the first fastener, the second fastener and the crosspiece are configured for distributing a plurality of vibrations resulting from hitting a ball with separable and discreet barrel, the crosspiece minimizing the vibrations transferred to the separable and discreet handle and the rod.

* * * * *